US006840187B2

(12) United States Patent
Tible

(10) Patent No.: US 6,840,187 B2
(45) Date of Patent: Jan. 11, 2005

(54) DEVICE AND METHOD FOR CLEANING PARTS OF A BOAT IMMERSED IN WATER

(75) Inventor: Jean-Philippe Tible, Pleneuf-Val-Andre (FR)

(73) Assignee: Advanced Boat Cleaning Technology, Pleneuf Val Andre (FR)

( * ) Notice: Subject to any disclaimer, the term of this patent is extended or adjusted under 35 U.S.C. 154(b) by 0 days.

(21) Appl. No.: 10/432,355

(22) PCT Filed: Nov. 28, 2001

(86) PCT No.: PCT/FR01/03758

§ 371 (c)(1),
(2), (4) Date: Aug. 20, 2003

(87) PCT Pub. No.: WO02/44020

PCT Pub. Date: Jun. 6, 2002

(65) Prior Publication Data

US 2004/0074431 A1 Apr. 22, 2004

(30) Foreign Application Priority Data

Nov. 29, 2000 (FR) ..... 00 15393

(51) Int. Cl.[7] ..... B63B 59/08
(52) U.S. Cl. ..... 114/222; 15/1.7
(58) Field of Search ..... 114/222; 15/1.7

(56) References Cited

U.S. PATENT DOCUMENTS 3,256,642 A * 6/1966 Fonti ..... 451/90
3,868,268 A * 2/1975 Tusch et al. ..... 427/318

FOREIGN PATENT DOCUMENTS

| | | |
|---|---|---|
| FR | 2110527 | 5/1972 |
| FR | 2151198 | 3/1973 |
| FR | 2369964 | 11/1977 |
| FR | 2673417 | 9/1992 |
| JP | 60029394 | 2/1985 |

* cited by examiner

*Primary Examiner*—Jesus D. Sotelo
(74) *Attorney, Agent, or Firm*—Jacobson Holman PLLC

(57) ABSTRACT

An apparatus for cleaning the underwater portions of a boat having at least one cleaning unit with an ejection element for generating a jet of cleaning fluid under high pressure, and a manifold for generating jets of gas under low pressure. The manifold enables a space to be defined around the cleaning fluid jet in which space density is considerably reduced relative to the density of the surrounding water, such as a space that is free or practically free from water; this space extends from the ejection element to the surface for cleaning of the underwater portions. The apparatus is applicable to cleaning boats, such as sail boats, motor boats, and canal boats, without it being necessary to take them out of the water.

11 Claims, 2 Drawing Sheets

DEVICE AND METHOD FOR CLEANING PARTS OF A BOAT IMMERSED IN WATER

This is a nationalization of PCT/FR01/03758 filed Nov. 28, 2001 and published in French.

The present invention relates to a method of cleaning underwater portions of a boat, which method can be implemented without it being necessary to take the boat out of the water.

The invention also provides cleaning apparatus enabling the method to be implemented.

The underwater portions of a boat, and in particular of the hull, the keel, and the cheek of the rudder, are generally protected by applying a special "antifouling" paint thereto. Such paint gives off toxic agents (copper oxides, mercury arsenate) which slow down the proliferation and the fixing of seaweed and shell-fish to the hull of the boat. Nevertheless, the effectiveness of such paint is limited in time and residues of the paint together with the seaweed and shell-fish that have nevertheless managed to become fixed to the hull need to be removed periodically prior to applying a new layer of antifouling paint.

In addition, it is necessary to keep a hull clean in order to maintain the performance and the speed of the boat while sailing.

The hull is generally cleaned by mechanical means such as brushes, tools, and a jet of water under pressure serving to brush, scrape, or strip the hull. Unfortunately, in order to be able to perform such cleaning properly, the boat needs to be taken out of the water.

In order to take the boat out of the water, it is possible to use a hoist to life it onto a quay, but that operation is lengthy, difficult, and expensive, or else it is possible to position the boat in a careening place at high tide and wait for the tide to go down enough to be able to work in air. Nevertheless, the tidal solution leaves little time for cleaning the hull before the tide comes back in, and also assumes that the rise of the tide is sufficient to uncover the hull completely.

Documents WO 91/18785 and FR 2 723 908 disclose installations for cleaning boats that are afloat by using rotary brushes, similar to those which exist for washing cars.

Document FR 2 369 964 also discloses an apparatus for cleaning and apparatus for rinsing the underwater portions of boat hulls.

The cleaning apparatus comprises a rotary brush actuated by a motor and placed under a cover. A device enables jets of air to be directed into the inside of the cover so as to reduce the loss of drive from the motor that would otherwise occur if the brush were turning in water. Nevertheless, that cleaning apparatus does not make use of jets of water.

Furthermore, the rinsing apparatus comprises means for forming jets of water under high pressure mounted under an air-filled cover, in order to isolate said jets of water from the surrounding water. Nevertheless, that apparatus does not make provision for delivering jets of gas under low pressure around said jets of rinsing water.

The two above-described apparatuses, each provided with a respective cover, must consequently be applied against the hull to be cleaned, thereby limiting the area which can be cleaned on each pass of the apparatus.

Document GB 2 078 546 discloses apparatus for cleaning the underwater structures of offshore oil platforms that makes use simultaneously of a jet of water and a jet of air under pressure, the jet of air serving to reduce the noise of such apparatus greatly so as to improve the working conditions of divers using the apparatus.

For this purpose, that apparatus has a nozzle for generating water at high speed surrounded by an annular orifice through which air is ejected.

Nevertheless, in such apparatus, the annular sleeve of air is present only for sound-insulation purposes and the cleaning jet of water always operates in water. Consequently, the diver must apply that apparatus very closely (a few centimeters) to the underwater structure for cleaning in order to avoid the jet of water being excessively slowed down by seawater. That limits the area of the surface which can be cleaned on each pass of the apparatus. The total time required for cleaning is thus increased.

Finally, the abstract of Japanese patent No. 60-029394 discloses cleaning apparatus operating underwater and comprising firstly means for generating a jet of water under pressure through a tube, and secondly means for ejecting a jet of air under high pressure through an annular passage surrounding said tube.

The jet of water under high pressure passes inside a cylinder whose walls are formed by a layer of air, but which nevertheless contain water. The jet of water must therefore pass through a high density zone of water in order to reach the hull, thereby considerably reducing its effectiveness.

An object of the present invention is to develop apparatus and a method for cleaning underwater portions of a boat, making it possible to use a conventional nozzle for ejecting cleaning fluid under high pressure, which jet would be made ineffective for cleaning in the absence of the present invention, or at least less effective, by the presence of the water around the boat. Another object of the invention is to clean a large area of the hull on each pass of the apparatus, thereby reducing the total time required for cleaning, while nevertheless performing high quality cleaning without taking the boat out of the water.

For this purpose, the invention provides apparatus for cleaning the portions of a boat that are underwater, the apparatus being of the type comprising at least one cleaning unit having first generator means for generating a jet of cleaning fluid under high pressure, and second means for generating jets of gas.

In accordance with the invention, said first generator means enable a cleaning fluid jet to be produced in the form of a fluid sheet, and said second means comprise a manifold provided with a series of nozzles connected to a pressurizer and to a tank or a supply of gas, said manifold enabling jets of gas under low pressure to be generated so as to define a space around said cleaning fluid sheet in which space density is considerably less than the density of the surrounding water, such as a space that is free or practically free from water, said space extending over the entire length of said cleaning fluid sheet from said first generator means all the way to the area of said underwater portions that is to be cleaned, said manifold being disposed beneath said first generator means in such a manner that its own longitudinal axis extends substantially in the same vertical plane as the plane containing the ejection axis of said cleaning fluid sheet, which sheet extends substantially vertically inside said space that is free or practically free from water.

Thus, the sheet of fluid under high pressure which is delivered into said space does not waste energy pushing away the water in which the boat is immersed. Such apparatus enables the hull to be cleaned properly while placing the cleaning unit at a distance 5 centimeters (cm) to 30 cm from the hull. This makes it possible to clean a large area of the hull in a single pass of the apparatus.

In addition, such apparatus is ecological since it makes use of cleaning means that are mechanical only.

According to other possible but non-limiting and advantageous characteristics of the invention:

said first generator means comprise a nozzle connected to a compressor and to a tank or supply of cleaning fluid;

the apparatus includes means for generating a reaction force to compensate the force that results from the ejection of the cleaning fluid by said first means;

said means for generating a compensating reaction force consists in additional means suitable for generating a jet of fluid in the opposite direction to the jet of cleaning fluid;

the apparatus includes means for channeling the jets of gas generated by said second means, such as a deflector disposed longitudinally along said manifold;

said cleaning unit is mounted on an articulated arm allowing said cleaning unit to be moved in three mutually perpendicular directions, the displacement of said articulated arm being controlled by a computer or a programmable controller as a function of the profile of said underwater portions;

the apparatus comprises a plurality of cleaning units mounted on an articulated support suitable for matching the shape of the hull of a boat for cleaning, the support being mounted on at least one guide rail provided on a quay or a pontoon beside which the boat for cleaning is moored, said support being capable of sliding along said guide rail under the control of a computer or a programmable controller so as to move said cleaning unit along the entire length of the boat and as a function of the profile of said underwater portions; and the apparatus includes sensors for measuring the shape of the underwater portions for cleaning, said sensors being connected to said computer or programmable controller in order to servo-control the displacement of the cleaning unit(s) to the shape of the hull.

The invention also provides a method of cleaning the underwater portions of a boat by simultaneously projecting a jet of cleaning fluid under high pressure against said underwater portions together with jets of gas.

This method is remarkable in that said jets of gas are generated at low pressure beneath said jet of cleaning fluid in such a manner as to define a space around said fluid jet in which space density is considerably less than the density of the surrounding water, such as a space that is free or practically free from water, thereby isolating the fluid jet from the surrounding mass of water, said space extending over the entire length of said cleaning fluid jet.

Preferably the fluid is hot or cold water or steam, and the gas is air.

In addition, the method can be implemented using the above-specified apparatus.

Other characteristics and advantages of the invention appear on reading the following description of a preferred embodiment of the invention. This description is made with reference to the accompanying drawings, in which.

Figure 1:
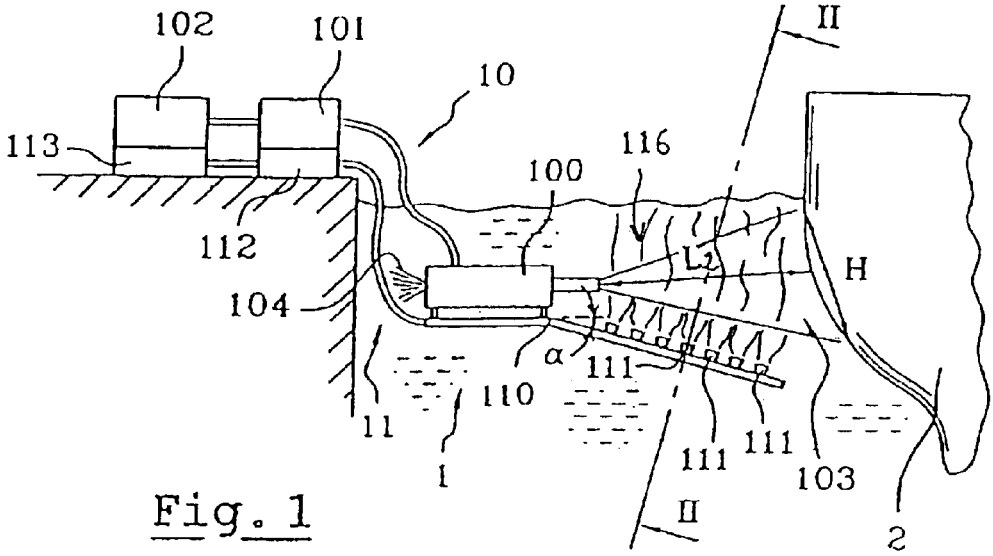
FIG. 1 is a diagram showing the cleaning unit of the apparatus of the invention.

The apparatus of the invention comprises at least one cleaning unit 1 as shown in FIG. 1 for cleaning underwater portions 2 of a boat.

In the description below and in the claims, the term "underwater portions" of a boat covers not only the hull, but also the keel, the rudder, the propeller, and the propeller shaft. In the drawings, and for the purposes of simplification, the underwater portions are represented by the hull of the boat.

The cleaning unit 1 of the invention may be of known type. It comprises means 10 for generating a jet of cleaning fluid under high pressure. By way of example, these means comprise an ejection nozzle 100 connected by a hose to a tank or a supply 102 of cleaning fluid, a compressor 101 being interposed between said tank and said nozzle 100. As an indication, the high pressure at which the fluid is ejected is about $120\times10^5$ Pascals (Pa) to $200\times10^5$ Pa.

The cleaning fluid is advantageously hot or cold water or steam.

Advantageously, the ejection nozzle is configured in such a manner that the jet of cleaning fluid is in the form of a sheet or a pencil of fluid 103 and not merely a cylindrical jet. In other words, as seen from the side in FIG. 1, the sheet 103 is of a triangular, flared shape going from the ejection end of the nozzle towards the hull 2 of the boat, and when seen end-on as in FIG. 2, it is oblong in shape having a width $L_1$ that is small. This sheet 103 extends vertically.

By way of example, at the point of contact between the fluid sheet 103 and the surface 2 for cleaning, the width $L_1$ of said sheet is approximately 0.2 cm to 1 cm, while its height H is about 5 cm to 30 cm. In addition, the nozzle 100 is held at a distance lying in the range 5 cm to 30 cm from the surface to be cleaned as a function of the energy needed for dislodging the accumulated fouling and as a function of the programming of the means for moving the cleaning unit 1, which means are described below. Consequently, the length $L_2$ of said sheet of water varies likewise in the range approximately 5 cm to 30 cm.

Finally, the ejection nozzle 100 is advantageously provided on its rear face opposite from the face where the fluid sheet 103 is ejected with means 104 for generating a reaction force to compensate for the force that results from ejecting the cleaning fluid 103. These means 104 are constituted, for example, by fluid ejection means serving to counter the reaction force exerted by the nozzle 100 under the effect of the thrust generated by the fluid sheet 103. The means 104 can be constituted by a nozzle for ejecting a liquid or a gas taken from outside the cleaning unit 1 or by means of a pump for recirculating the seawater in which the cleaning unit 1 is immersed.

The cleaning unit 1 also comprises means 11 for generating a jet of gas at low pressure. In practice, it suffices for the pressure of the gas to be greater than the pressure that exists at the depth in the water where cleaning is taking place. By way of example, this pressure can be about one-tenth of a bar to a few bars (where 1 bar is equal to $10^5$ Pa).

These means 11 comprise a manifold 110 having a series of nozzles 111 and connected to a gas tank or supply 113 via a pressurizer 112. The gas is advantageously air, for reasons of availability.

Figure 2:
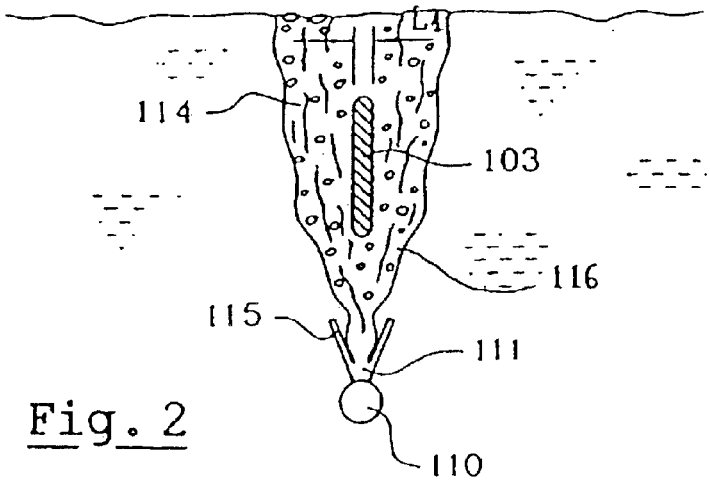
FIG. 2 is a diagrammatic section view of the sheet of cleaning fluid and the space that is free or practically free from water, the section being taken on line II—II of FIG. 1.

The bubbles and air jets 116 created by the manifold 110 serve to define a space 114 that is free or practically free of water (e.g. seawater if the boat is in a port, or fresh water if the boat is on a lake), and extends in a shape of cross-section that flares slightly upwards towards the surface of the water (see FIG. 2).

More precisely, the space or volume 114 contains a mixture of a small amount of the water in which the boat is immersed and a large amount of gas coming from the manifold 110. Consequently, inside this volume, density is much lower than the density of the surrounding water.

This manifold 110 is secured to the nozzle 100 and lies under it so that its own longitudinal axis extends substantially in the same vertical plane as that containing the ejection axis of said nozzle 100, i.e. the ejection axis of the fluid sheet 103, and the nozzles 111 of said ramp lie beneath the fluid sheet 103. The fluid sheet 103 thus lies within the space 114 that is free or practically free of water, said space 114 extending longitudinally over the entire length of said sheet 103 from the nozzle 100 to the surface of the hull 2 for cleaning.

As shown in FIG. 1, the manifold 110 may be hinged relative to the nozzle 100 in such a manner as to slope downwards a little at an angle $\alpha$ relative to the ejection axis of the nozzle 100. This makes it possible to direct the flow of gas so that it always surrounds the fluid sheet 103 regardless of the point of the hull in front of which the cleaning unit 1 is located. The angle $\alpha$ is preferably determined so that the base of the triangular jet of cleaning fluid is parallel to said manifold.

Optionally, in advantageous manner and as shown in FIG. 2, the manifold 110 is provided with means for channeling the jets of gas 116, such as one of more deflectors 115 extending along its entire length, enabling the bubbles and the jets of gas 116 to be channeled into the zone surrounding the fluid sheet 103.

Figure 3:
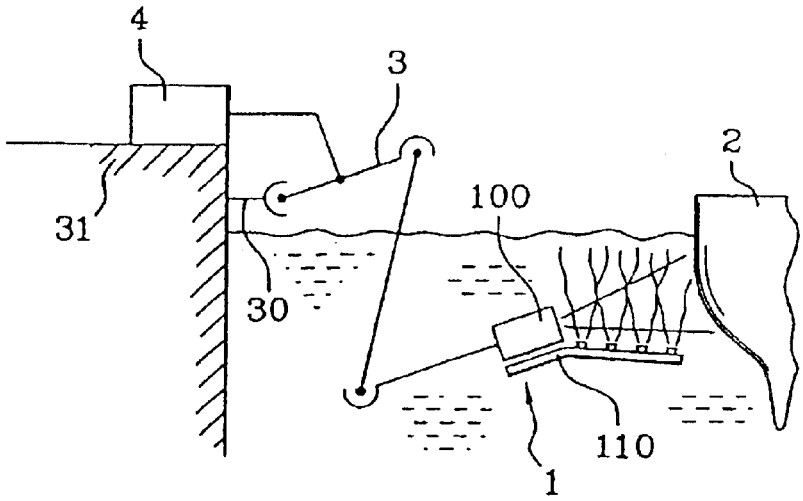
FIG. 3 is a diagram of a first variant embodiment of the cleaning apparatus of the invention.

As shown in FIG. 3, in a first variant embodiment of the invention, the cleaning unit 1 is mounted on an articulated arm 3, itself connected to a fixed support 30 mounted on a quay or a pontoon 31. The articulated arm 3 enables said unit 1 to be moved in three mutually perpendicular directions. In other words, the unit 1 can move in three dimensions so as to follow the shape of the hull 2 for cleaning.

This articulated arm 3 can be controlled by a computer 4 or a programmable controller.

Figure 4:
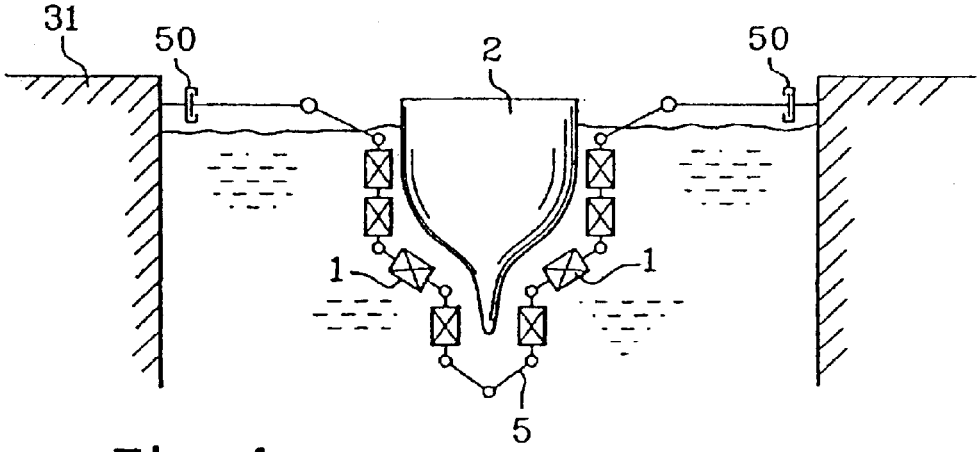
FIG. 4 is a diagram of a second variant embodiment of the cleaning apparatus of the invention.

A second variant embodiment is shown in FIG. 4. In this case, a plurality of cleaning units 1 are mounted on a support 5 which is articulated in such a manner as to be capable of matching the shape of the hull 2 of the boat for cleaning. This support 5 is mounted on at least one guide rail 50 provided on the quay or the pontoon 31 beside which the boat for cleaning is moored. The support 5 can slide on said guide rail 50 under the control of a computer or a programmable controller identical to that described above (but not shown in the figures), so as to move said cleaning units 1 along the entire length of the boat.

Installations as shown in FIGS. 3 and 4 may also include sensors for measuring the shape of the underwater portions 2 for cleaning, and connect it to said computer or programmable controller in order to servo-control the displacement of the cleaning unit(s) 1 to the shape of the hull 2.

These measurement sensors may be of any known type, and in particular they may be mechanical (feelers) or optoelectrical, for example similar to those used in certain automatic car-washing installations, and as described in document EP 0 507 757, for example. The measurements taken are stored in a computer and transmitted to means for controlling the displacement of the articulated arm 3 or the articulated support 5.

After measurements have been taken by these sensors, it becomes possible to clean the boat in a single pass of the apparatus shown in FIG. 4, or in three or more passes of the apparatus shown in FIG. 3.

The invention also provides a method of cleaning the underwater portions of a boat. The method comprises the steps consisting in directing a jet (or sheet) of cleaning fluid under high pressure against said underwater portions 2, while simultaneously ejecting jets of gas 116 beneath said fluid jet so as to define a space 114 that is filled with very little water and with a great deal of gas, or with gas only, and in which density is much less than the density of the surrounding water. This forms a space 114 around said cleaning fluid jet 103, which space is free or practically free from water, thereby isolating said fluid jet from the surrounding mass of water. This space 114 extends over the entire length of said cleaning fluid jet 103.

The method may be implemented, for example, using the above-described apparatus.

What is claimed is:

1. An apparatus for cleaning the portions of a boat that are underwater, the apparatus comprising at least one cleaning unit having first generator means for generating a jet of cleaning fluid under high pressure, and second means for generating jets of gas, said first generator means enabling a cleaning fluid jet to be produced in the form of a fluid sheet, and said second means including a manifold provided with a series of nozzles connected to a pressurizer and to a tank or a supply of gas, said manifold enabling jets of gas under low pressure to be generated so as to define a space around said cleaning fluid sheet in which space density is considerably less than the density of the surrounding water, said space being free or practically free from water and extending over the entire length of said cleaning fluid sheet from said first generator means to the area of said underwater portions that is to be cleaned, said manifold being disposed beneath said first generator means in such a manner that its own longitudinal axis extends substantially in the same vertical plane as the plane containing the ejection axis of said cleaning fluid sheet, which sheet extends substantially vertically inside said space that is free or practically free from water.

2. The cleaning apparatus according to claim 1, wherein said first generator means includes a nozzle connected to a compressor and to a tank or supply of cleaning fluid.

3. The cleaning apparatus according to claim 1, further comprising means for generating a reaction force to compensate the force that results from the ejection of the cleaning fluid by said first means.

4. The cleaning apparatus according to claim 3, wherein said means for generating a compensating reaction force includes additional means for generating a jet of fluid in the opposite direction to the jet of cleaning fluid.

5. The cleaning apparatus according to claim 1, further comprising means for channeling the jets of gas generated by said second means including a deflector disposed longitudinally along said manifold.

6. The cleaning apparatus according to claim 1, wherein said cleaning unit is mounted on an articulated arm allowing said cleaning unit to be moved in three mutually perpendicular directions, the displacement of said articulated arm being controlled by a computer or a programmable controller as a function of the profile of said underwater portions.

7. The cleaning apparatus according to claim 6, further comprising sensors for measuring the shape of the underwater portions for cleaning, said sensors being connected to said computer or programmable controller in order to servo-control the displacement of the cleaning unit(s) to the shape of the hull.

8. The cleaning apparatus according to claim 1, wherein said apparatus includes a plurality of cleaning units mounted on an articulated support suitable for matching the shape of the hull of a boat for cleaning, the support being mounted on at least one guide rail provided on a quay or a pontoon beside which the boat for cleaning is moored, said support being capable of sliding along said guide rail under the control of a computer or a programmable controller so as to move said cleaning unit along the entire length of the boat and as a function of the profile of said underwater portions.

9. A method of cleaning the underwater portions of a boat comprising the step of simultaneously projecting a jet of cleaning fluid under high pressure against said underwater portions together with jets of gas, said jets of gas being generated at low pressure beneath said jet of cleaning fluid in such a manner as to define a space around said fluid jet in which space density is considerably less than the density of the surrounding water so as to be free or practically free from water, thereby isolating the fluid jet from the surrounding mass of water, said space extending over the entire length of said cleaning fluid jet.

10. The cleaning method according to claim 9, wherein the fluid is water or steam, and the gas is air.

11. The cleaning method according to claim 9, said method being implemented using an apparatus comprising at least one cleaning unit having first generator means for generating a jet of cleaning fluid under high pressure, and second means for generating jets of gas, said first generator means enabling a cleaning fluid jet to be produced in the form of a fluid sheet, and said second means including a manifold provided with a series of nozzles connected to a pressurizer and to a tank or a supply of gas, said manifold enabling jets of gas under low pressure to be generated so as to define a space around said cleaning fluid sheet in which space density is considerably less than the density of the surrounding water, said space being free or practically free from water and extending over the entire length of said cleaning fluid sheet from said first generator means to the area of said underwater portions that is to be cleaned, said manifold being disposed beneath said first generator means in such a manner that its own longitudinal axis extends substantially in the same vertical plane as the plane containing the ejection axis of said cleaning fluid sheet, which sheet extends substantially vertically inside said space that is free or practically free from water.

* * * * *